US007578313B2

(12) United States Patent
Kozuka et al.

(10) Patent No.: US 7,578,313 B2
(45) Date of Patent: Aug. 25, 2009

(54) ROTARY PILOT VALVE

(75) Inventors: Daisuke Kozuka, Tochigi-ken (JP); Shuuji Hori, Tochigi-ken (JP)

(73) Assignee: Komatsu Limited, Minato-ku, Tokyo (JP)

( * ) Notice: Subject to any disclaimer, the term of this patent is extended or adjusted under 35 U.S.C. 154(b) by 445 days.

(21) Appl. No.: 10/800,794

(22) Filed: Mar. 15, 2004

(65) Prior Publication Data

US 2004/0187937 A1 Sep. 30, 2004

(30) Foreign Application Priority Data

Mar. 28, 2003 (JP) ..... 2003-090577

(51) Int. Cl.
*F15B 13/04* (2006.01)

(52) U.S. Cl. ..... 137/625.21; 137/625.23; 251/283; 251/297

(58) Field of Classification Search ..... 137/625.21, 137/625.22, 625.23; 251/283, 297
See application file for complete search history.

(56) References Cited

U.S. PATENT DOCUMENTS 2,182,459 A * 12/1939 Vickers ..... 137/625.23
2,946,348 A * 7/1960 North ..... 137/625.21
3,774,634 A * 11/1973 Bonney ..... 137/625.23
4,143,676 A * 3/1979 Ivony et al. ..... 137/625.23
5,301,922 A * 4/1994 Hayasaka ..... 137/625.23

FOREIGN PATENT DOCUMENTS

JP 56-66570 6/1981

* cited by examiner

*Primary Examiner*—John Rivell
(74) *Attorney, Agent, or Firm*—Fish & Richardson P.C.

(57) ABSTRACT

A rotary pilot valve in which a force required to operate the pilot valve is reduced and especially the pilot valve can be operated with a very small operating force as in a fingertip type, and the number of parts forming the pilot valve is reduced. In a body, a tank port, a pair of pump ports, a first output port, and a second output port are formed. In a cylindrical valve, a pair of notch grooves is formed and connected with each other by a balance hole. Variable throttles are formed on a side of the tank port and a side of the pump port of the notch groove. An open area of one of the variable throttles gradually increases while an open area of the other gradually reduces by tilting of an operating lever. Pressure oil lead into the notch groove through the variable throttle is output from the first output port as an intermediate throttle pressure.

9 Claims, 16 Drawing Sheets

ROTARY PILOT VALVE

BACKGROUND OF THE INVENTION

1. Field of the Invention

The present invention relates to a rotary pilot valve suitable as means for operating a hydraulic working apparatus.

2. Description of the Related Art

In general, in a rotary valve, a directional control valve is mounted inside a valve main body, an output port, a tank port, and a pump port connected to the directional control valve are provided, and the directional control valve is controlled by operation of an operating lever, so that a pilot pressure supplied from the pump port can be supplied under control to the output port (see Patent document 1, for example).

As shown in FIG. 22, in a directional control valve with variable throttle in Patent document 1, a hole 61 is formed at an axial center in a valve housing 60 and a spool 63 is fitted in the hole such that the spool can rotate and slide in the axial direction freely. A pump port 67 is provided in a central portion of the valve housing 60, two output ports 65 and 66 are provided on opposite sides of the pump port 67, and two tank ports 68 are so provided on the other side of the valve housing 60 as to be positioned outside the output ports 65 and 66.

Operating shafts 70, 70 passing through sliding holes 69, 69 provided in lid bodies 64, 64 are connected to opposite ends of the spool 63 and one of the operating shafts 70 is engaged with an elongated hole formed in an operating lever 72 through a pin 71. A lower end portion of the operating lever 72 is engaged with a ball receiving groove 74 through a ball 73.

At a central portion of the spool 63, a notch-shaped liquid passage portion 75 having such a width as to connect the pump port 67 to the output port 65 or the output port 66 and having a depth gradually increasing from opposite side edges toward a central portion is formed.

If the operating lever 72 is operated by rotation in a rotating direction of the spool 63, i.e., if the operating lever 72 is turned in a direction perpendicular to a paper face of FIG. 22, an open area of the liquid passage portion 75 with respect to the pump port 67 can be reduced. After operating the operating lever 72 by rotation to make the open area of the liquid passage portion 75 a predetermined area, the operating lever 72 is operated by rotation in a transverse direction in FIG. 22 to slide the spool 63 in the axial direction. It is possible to allow a predetermined flow rate to flow from the output port 65 or the output port 66 which has been connected to the pump port 67 through the liquid passage portion 75 by sliding of the spool 63.

In the rotary valve described in Japanese Patent Application Laid-open No. 56-66570 (see line 10 in a lower right column on page 1 to line 5 in an upper left column on page 3 and FIGS. 1 to 7), the operating lever 72 need be operated in two steps in such a manner as to rotate the spool 63 and to slide the spool 63 in the axial direction in order to output pressure oil from the output ports 65, 66. Moreover, a pressing force in a diameter direction which acts on the spool 63 due to an oil pressure from the pump port 67 and sliding resistances between the lid bodies 64, 64 and the operating shafts 70, 70 when the operating lever 72 is operated are always applied to the spool 63.

Therefore, in order to operate the operating lever, an operating force resisting the pressing force in the diameter direction due to the pressure oil and the sliding resistances between the lid bodies and the operating shafts is required. As a result, the operating lever is heavy to be operated and physical fatigue builds up due to operation of the rotary valve, which worsens an operating environment. In addition, a structure including the lid bodies for allowing the operating shafts to project from the valve housing and a structure in which a sector-shaped plate 76 for supporting the operating lever is provided increase the number of parts as the rotary valve and the respective parts require high working accuracy, which requires much time to assemble the pilot valve.

SUMMARY OF THE INVENTION

It is an object of the present invention to provide a rotary pilot valve in which an operating force of a pilot valve is reduced and especially the pilot valve can be operated with an extremely small operating force with a finger as in a fingertip type and the number of parts forming the pilot valve is also reduced.

The above objects can be achieved effectively by the invention according to the respective claims in this application comprising the following matters.

To achieve the above objects, according to one aspect of the invention, a rotary pilot valve comprises: a notch groove formed in a peripheral face of a rotary valve; a tank port, a pump port, and an output port formed in an inner peripheral face of a body; variable throttles respectively formed on a pump port side and a tank port side of the notch groove; and an operating lever for operating the rotary valve by rotation, wherein open areas of the pair of variable throttles are formed in such shapes that the throttle open area of one of the variable throttles gradually increases while the throttle open area of the other gradually reduces according to an angle of rotation of the rotary valve by the operating lever, and an intermediate throttle pressure between the pump port and the tank port, which is substantially proportional to the rotation angle of the rotary valve, is output from the notch groove to the output port.

In the invention, the rotary valve is employed as the pilot valve, and the variable throttles are respectively formed on the pump port side and the tank port side of the notch groove connecting the pump port and the tank port formed in the peripheral face of the rotary valve.

Moreover, the open areas of the pair of variable throttles formed on the pump port side and the tank port side are formed in such shapes that the open area of one of the variable throttles gradually increases while the open area of the other gradually reduces according to the angle of rotation of the rotary valve by the operating lever.

As a result, the intermediate throttle pressure between the pump port and the tank port can be controlled so as to be substantially proportional to the rotation angle of the rotary valve and the controlled intermediate throttle pressure can be output from the notch groove to the output port.

In addition, an operating force only for rotating the rotary valve is substantially sufficient as the operating force of the operating lever, so that the operating force of the operating lever can be reduced. Especially, since a pair of notch grooves is formed at balancing positions in a diameter direction of the rotary valve and the notch grooves are connected to each other by a balance hole, oil pressure reaction forces in the diameter direction of the rotary valve due to pressure oil in the notch grooves can be balanced out. At this time, projected areas of the pair of notch grooves need be equal to each other. Consequently, the operating lever can be formed as the lever of what is called a fingertip type which can be operated with a fingertip only.

By forming the open areas of the pair of variable throttles formed on the pump port side and the tank port side in such shapes that the open area of one of the variable throttles gradually increases while the open area of the other gradually reduces according to the angle of rotation of the rotary valve by the operating lever, the intermediate throttle pressure between the pump port and the tank port can be controlled to be substantially proportional to the rotation angle of the rotary valve. Therefore, the pilot pressure substantially proportional to the rotation angle of the rotary valve which is the operated amount by the operating lever, i.e., the intermediate throttle pressure between the pump port and the tank port can be output from the output port. As a result, the pilot pressure according to the operated amount of the operating lever can be output from the output port and operability of working machinery by an operator can be improved.

Two output ports may be provided in a normal rotating direction and a reverse rotating direction of the rotary valve. By switching the notch groove between the two output ports, it is possible to switch and select between the output ports and to output the pilot pressure according to the operated amount of the operating lever from the selected output port.

At this time, at least one notch groove may be formed. It is also possible that the pair of notch grooves is formed in such positions in the diameter direction of the rotary valve that the oil pressure reaction forces balance each other out and the notch grooves are connected by the balance hole. If the pair of notch grooves is formed, it is also possible that one of the notch grooves is selectively connected to the two output ports.

It is also possible that two pairs of notch grooves are formed and disposed to be separate from each other in a direction of a rotation axis of the rotary valve, and that a set of the tank port, the output port, and the pump port is disposed at the notch grooves of each pair.

Respective output ports may be disposed between the tank port and the pump port or may be formed in positions which are symmetric with respect to a center of rotation of the rotary valve which faces the position between the tank port and the pump port, so that the intermediate throttle pressure obtained in one of the notch grooves connected by the balance hole may be output from the other notch groove.

A pair of pump ports is preferably disposed in such positions as to sandwich the tank port in the middle and in positions facing each other around the center of the rotation of the rotary valve. It is also possible that the pair of pump ports is respectively disposed so as to separate from each other in the direction of the rotation axis of the rotary valve.

An automatic return mechanism may be provided so that the operating lever can automatically be returned to an initial position before starting of tilting after the operating lever has been tilted. As the automatic return mechanism, a conventionally known automatic return mechanism using a torsion spring or an automatic return mechanism using a pair of springs, a leaf spring, or the like may be used.

A mechanism for retaining the operating lever in a predetermined tilting position may be provided. As the retaining mechanism, a conventionally known detent mechanism or the like may be used, for example.

As the rotary valve, the various rotary valves in forms of a cylindrical valve, a ball valve, a disc valve, and the like may be used. Especially when the cylindrical valve is used, a plurality of cylindrical valves can be arranged in series along a direction of their rotation axes.

By forming the cylindrical valve so that it can be shifted to a plurality of positions in the direction of the rotation axis, the controlled intermediate throttle pressure can be output from a selected output port by rotating the rotary valve in one of normal and reverse directions in each shift position. In other words, if the cylindrical valve is formed so that it can be shifted to a first shift position and a second shift position in the direction of the rotation axis by sliding the cylindrical valve in the direction of the rotation axis, the pilot pressure can be output selectively from four output ports in total by rotating the rotary valve in normal and reverse directions in the first shift position and the second shift position.

By forming a body for housing the rotary valve into an airtight housing structure, invasion of dust such as trash and rainwater into the rotary valve can be prevented and the rotary valve can always be operated smoothly in a stable state. Further, by forming the body so that it can be divided into the minimum required number of parts, e.g., two or three parts, and by airtightly providing sealing members between end faces, i.e., faces where the body is divided, the integral body can be formed.

With these structures, a structure of the pilot valve can be simplified, repairability in maintenance can be improved, and the number of parts forming the pilot valve can be reduced.

DETAILED DESCRIPTION OF PREFERRED EMBODIMENTS

Preferred embodiments of the present invention will be concretely described below based on the accompanying drawings.

The invention can effectively be applied as a rotary pilot valve in a hydraulic controller for traveling of construction equipment and earth-moving equipment such as a hydraulic shovel and in a hydraulic controller for an actuator operation such as an attachment operation of the hydraulic shovel such as a breaker operation and a crusher operation.

The hydraulic controller to which the rotary pilot valve of the invention is applied is not limited to the hydraulic controller for traveling of the construction equipment and the earth-moving equipment and the hydraulic controller for an actuator. The rotary pilot valve of the invention can be applied to a hydraulic controller for supplying pressure oil under control to the hydraulic equipment driven and controlled by a hydraulic flow rate.

The rotary pilot valve of the invention can be used as a substitute for a pilot valve used normally in the hydraulic controller. The rotary pilot valve of the invention is not limited to the preferred embodiments described below and naturally includes a technical range to which a person skilled in the art can easily apply the invention. The rotary valve is not limited to a cylindrical valve, a ball valve, a disc valve which will be described below and naturally includes a rotary pilot valve capable of outputting an intermediate throttle pressure as a pilot pressure by rotating a rotary valve to which the person skilled in the art can easily apply the invention of the present application.

Figure 1:
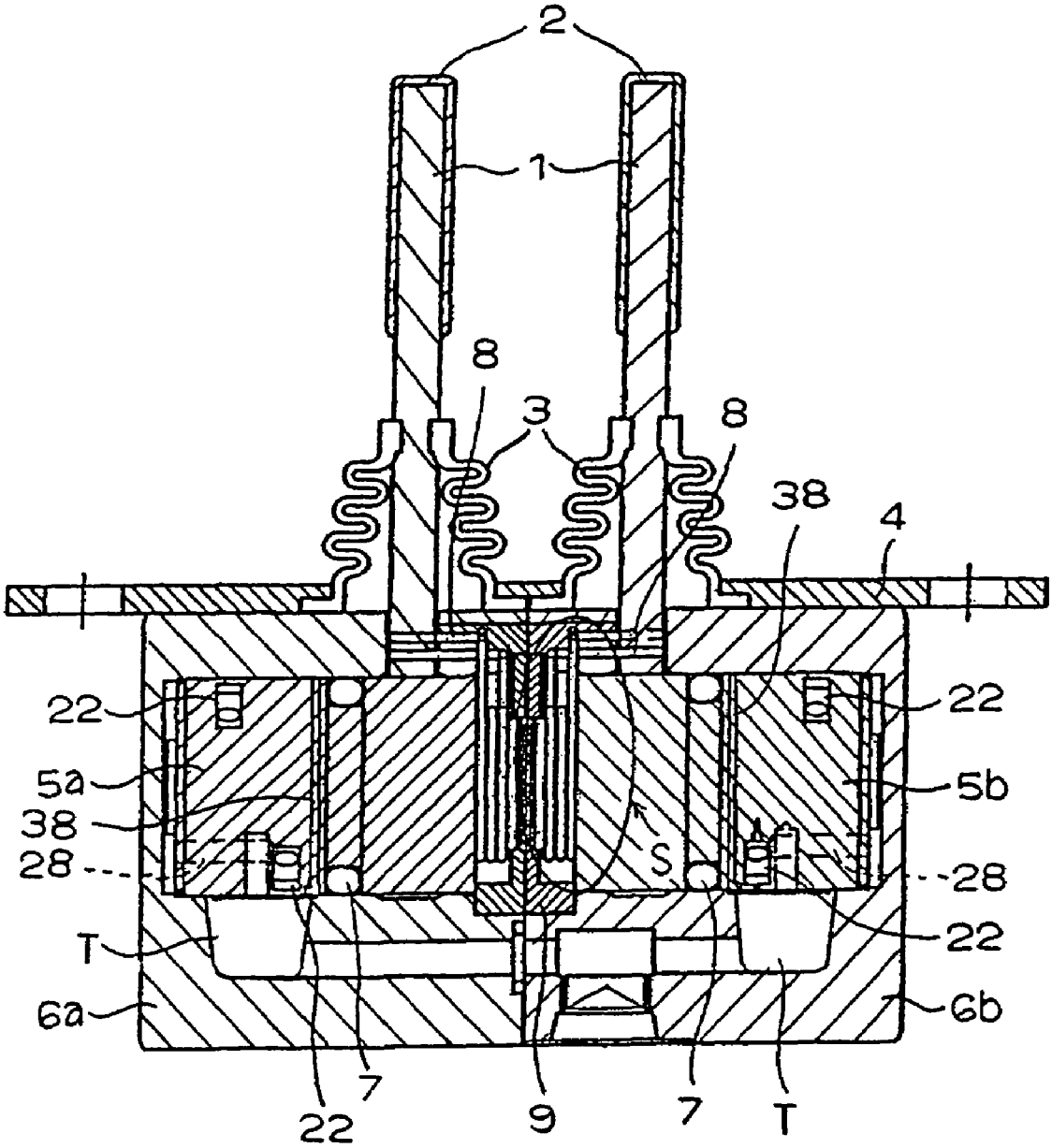
FIG. 1 is a sectional view of a rotary pilot valve in a first embodiment in the present invention.
Figure 2:
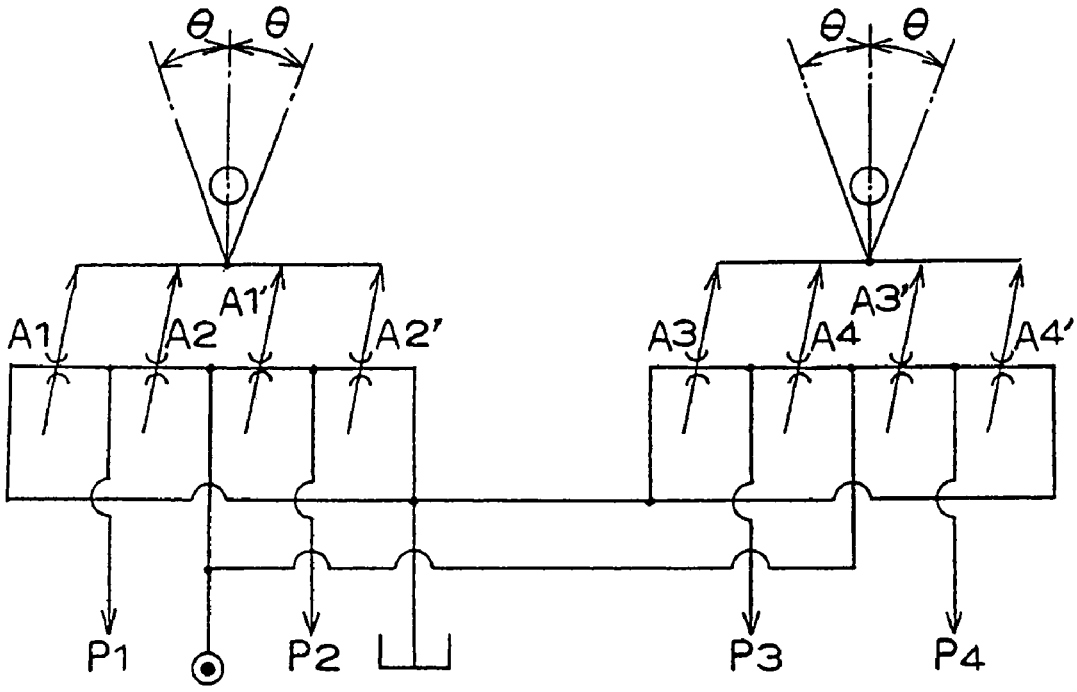
FIG. 2 is an oil hydraulic circuit diagram in FIG. 1.
Figure 3A:
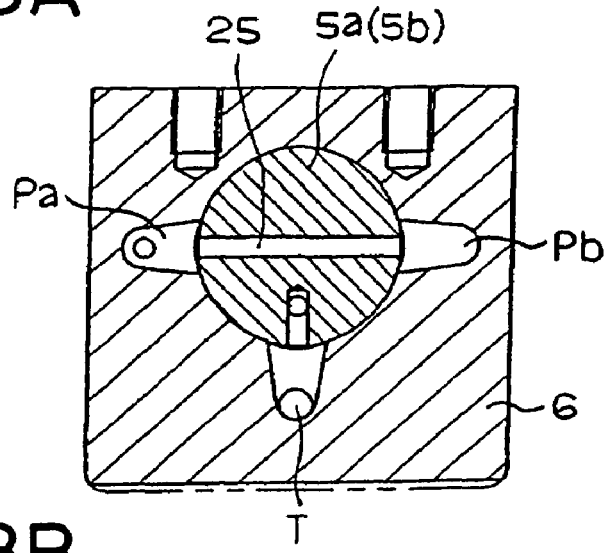
FIGS. 3A to 3C are sectional views taken in respective positions in FIG. 1.
Figure 3B:
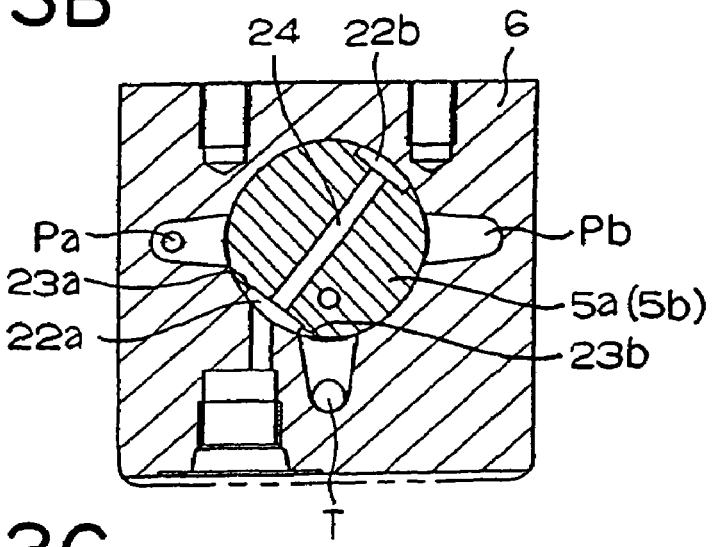
Figure 3C:
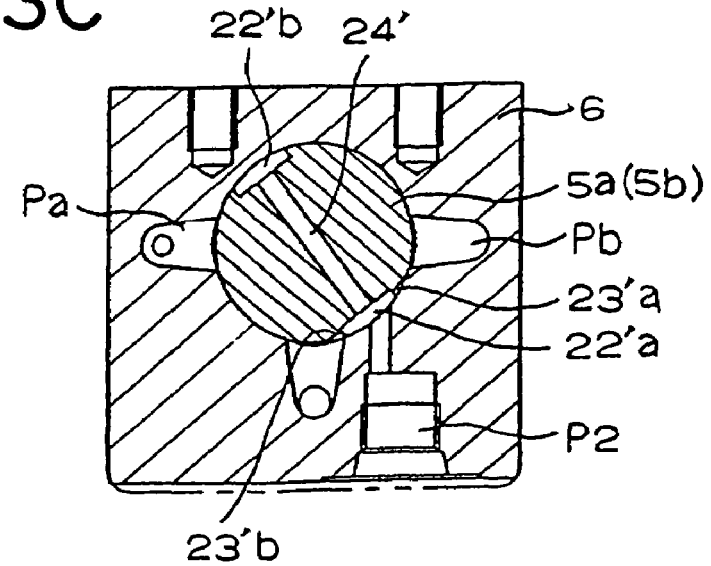

FIG. 1 shows a first embodiment of the invention and is a sectional schematic diagram of a rotary pilot valve in which a pair of cylindrical valves is used as a rotary valve. FIG. 2 shows an oil hydraulic circuit diagram in FIG. 1. FIGS. 3A to 3C show sectional views taken in respective positions in FIG. 1.

In FIG. 1, a pair of cylindrical valves 5*a* and 5*b* of is housed in series in housing spaces in a left body 6*a* and a right body 6*b* with their faces joined to each other such that the valves can be rotated and slid freely. Operating levers 1, 1 passing through the left and right bodies 6*a* and 6*b* and a plate 4 are respectively mounted to the pair of cylindrical valves 5*a* and 5*b*. Because the pair of cylindrical valves 5*a* and 5*b* is arranged in series in a direction of a rotation axis and is symmetrical having a same structure, the one cylindrical valve 5*a* and structures belonging to it will be described below, and description of the other cylindrical valve 5*b* and structures belonging to it will be omitted with using the same member reference numerals. If description of the cylindrical valve 5*b* and the structures belonging to it is necessary, they will be described as occasion demands.

A boot 3 is provided between a side of a lower end portion of the operating lever 1 and the plate 4 and airtightly covers an inside of the body 6*a*. A lever cover 2 is provided to an upper end portion of each operating lever 1 so as to facilitate gripping and operation of the operating lever 1 by an operator. The body 6*a* and the plate 4 are respectively formed with guide grooves for allowing tilting of the each operating lever 1. By tilting the operating lever 1 along the guide grooves, the cylindrical valve 5*a* can be rotated about its rotation axis.

Figure 5:
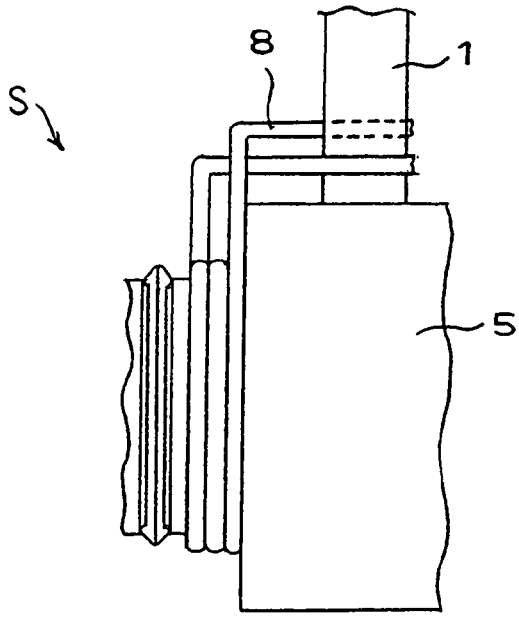
FIG. 5 is a schematic diagram of an automatic return mechanism.

A seal 7 is provided to an outer peripheral portion of the cylindrical valve 5*a* to create a liquid-tight state between the cylindrical valve 5*a* and the body 6*a*. As shown in FIG. 5, a torsion spring 8 is provided to the each operating lever 1 and the each operating lever 1 can automatically be returned to an initial position which is a tilting start position. In other words, by tilting the operating lever 1 against a spring force of the torsion spring 8 and then stopping application of an operating force to the operating lever 1, the operating lever 1 automatically returns to the initial position which is the tilting start position due to a restoring force of the torsion spring 8 in which a torsional force has built up.

Figure 4:
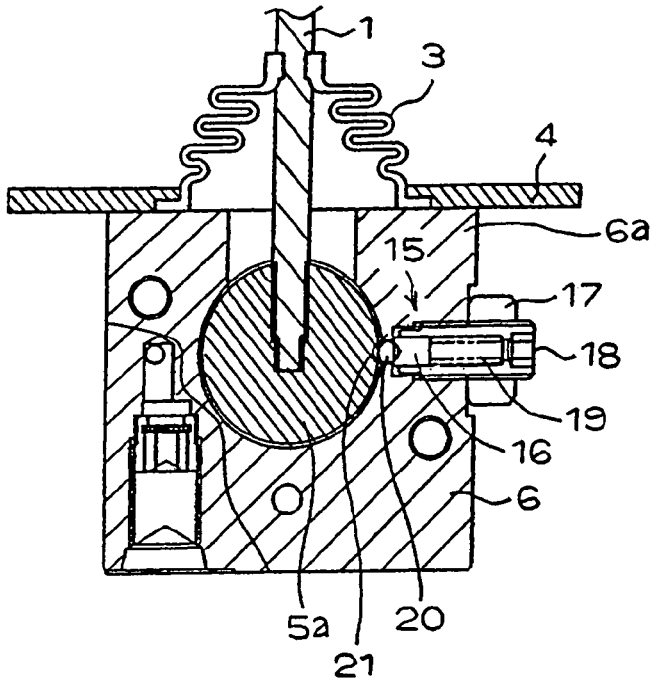
FIG. 4 is a sectional view of a detent mechanism.

Furthermore, the predetermined number of recessed portions 21 are formed on an outer peripheral face of the cylindrical valve 5*a* and the cylindrical valve 5*a* can be retained in a position where each recessed portion 21 is formed by engagement of a detent mechanism 15 provided to the body 6*a* and the recessed portion 21 with each other, as shown in FIG. 4. In other words, the detent mechanism 15 can be formed of a plug 18 mounted to the body 6*a* through a nut 17, a spring 19 disposed in the plug 18, a piston 16 pressed by the spring 19, and a ball 20 disposed together with the piston 16 in the plug 18 to be able to project and retract. By engagement of the ball 20 with the recessed portion 21 formed in a predetermined position on the outer peripheral face of the cylindrical valve 5*a*, the cylindrical valve 5*a* can be retained in a predetermined rotating position, i.e., a predetermined tilting position of the operating lever 1. The recessed portions may be formed in a plurality of positions such as the initial position and a maximum tilting position of the operating lever 1 with respect to one cylindrical valve.

In the body 6*a*, a tank port T, a pair of pump ports Pa and Pb, a first output port P1, and a second output port P2 are formed. At this time, a third output port P3 and a fourth output port P4 in the body 6*b* are different output ports from the first and second output ports P1 and P2. In other words, as shown in FIG. 2, controlled pilot pressures can be output from the four output ports P1 to P4 by the left and right cylindrical valves 5*a* and 5*b*. At this time, as shown in FIG. 2, the tank ports T and the pump ports Pa in the respective cylindrical valves 5*a* and 5*b* have common duct structures.

On the cylindrical valve 5*a*, in balance positions in a diameter direction of the cylindrical valve 5*a*, i.e., symmetric positions with respect to a center of rotation of the cylindrical valve, a pair of notch grooves 22*a*, 22*b* and a pair of notch grooves 22′*a* and 22′*b* separate from the notch grooves 22*a*, 22*b* in a direction of the rotation axis of the cylindrical valve are formed. Between the notch grooves 22*a* and 22*b* and between the notch grooves 22′*a* and 22′*b*, balance holes 24 and 24' for connecting the notch grooves respectively are formed. At this time, projected areas of the respective pairs of notch grooves 22*a*, 22*b* and 22′*a* and 22′*b* are equal to each other.

An oil passage 25 connecting the pump ports Pa and Pb is formed and always connects the pump ports Pa and Pb in a range of a rotation angle of the rotary valve 5*a*. It is also possible that the pump port Pa and the pump port Pb are separately connected to a pilot initial pressure source.

Disposed positions of the pump port Pa and the pump port Pb and the disposed positions of the two pairs of notch grooves 22*a*, 22*b* and 22′*a*, 22′*b* are balance positions in the diameter direction of the cylindrical valve 5*a*, respectively. Therefore, in the cylindrical valve 5*a*, hydraulic reaction forces in the diameter direction can balance each other out through the balance hole 24 in a circumferential direction.

By connecting a left end portion of the cylindrical valve 5*a* and the tank port T by a tank hole 28, it is possible to prevent accumulation of pressure in the left end face of the cylindrical valve 5*a*. As the tank hole 28, a notch other than a through hole can also be formed in a peripheral face of the cylindrical valve 5*a*. In the cylindrical valve 5*b*, a right end portion of the cylindrical valve 5*b* and the tank port T are connected by a tank hole 28 or a notch.

Moreover, a drain groove 38 is formed along the seal 7 and is connected to the tank port T, thereby an action of a force in a thrust direction on the drain groove 38 is prevented.

As a result, the force in the thrust direction does not act on the cylindrical valve 5*a*. In addition, a combination of this structure and the above-described structure with which the hydraulic pressure in the diameter direction does not act on the cylindrical valve 5*a* does not generate a resistance in an opposite direction to rotation of the cylindrical valve 5*a* and the operating lever 1 can be moved with a small operating force by a finger.

The pair of notch grooves is not demanded necessarily and it is also possible that the notch groove is formed on one side without forming the balance hole 24. It is also possible that the notch grooves are not disposed to be separate from each other in the direction of the rotation axis of the cylindrical valve 5*a* and that one notch groove formed with variable throttles by normal and reverse rotation of the cylindrical valve 5*a* is used in common to connect the tank port T and the pump port Pa to each other and the tank port T and the pump port Pb to each other so as to obtain the intermediate throttle pressure.

On a side of tank port T and a side of the pump ports Pa and P'a side in the notch grooves 22*a* and 22'*a*, variable throttles 23*a*, 23*b* and variable throttles 23'*a*, 23'*b* are formed. Because the variable throttles 23*a*, 23*b* and the variable throttles 23'*a*, 23'*b* have the same structures, the structures of the variable throttles 23*a* and 23*b* will be described below.

In FIG. 3B, a case that the cylindrical valve 5*a* rotates clockwise will be described as an example. An open area A1 of the variable throttle valve 23*a* on the side of the pump port Pa gradually increases and an open area A2 of the variable throttle 23*b* on the side of the tank port T gradually reduces on the other hand as the cylindrical valve 5*a* rotates clockwise.

If the operating lever 1 is in the tilting start position, the notch groove 22*a* does not communicate with the pump port Pa and communicates with the tank port T. At this time, there is no necessity to form variable throttles at the notch groove 22*b*. However, if disposed positions of the tank port T and the pump ports Pa, Pb are reversed, i.e., the pump ports Pa, Pb are in the position of the tank port and the tank port T is in the positions of the pump ports Pa, Pb, it is also possible that each of the pair of notch grooves 22*a* and 22*b* is formed with the variable throttle, the tank port T and the pump port Pa are connected to each other by the notch groove 22*a* according to the rotating direction of the cylindrical valve 5*a*, and that the tank port T and the pump port Pb are connected to each other by the notch groove 22*b* when the cylindrical valve 5*a* rotates in a direction opposite to the above rotating direction.

Figure 6:
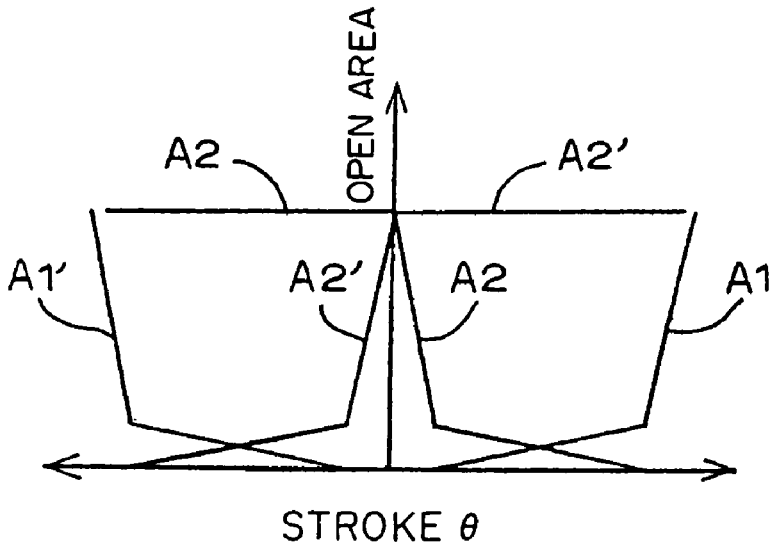
FIG. 6 shows opening characteristics of variable throttles.

Relationships between the open areas of the variable throttles and the rotation angle of the cylindrical valve will be further described by using FIG. 6. In an upper right quadrant of FIG. 6, the relationships between the open areas of the variable throttles 23*a*, 23*b* in the notch groove 22*a* and the rotation angle Θ of the cylindrical valve 5*a* are shown. In the upper left quadrant, the relationships between the open areas of the variable throttles 23'*a*, 23'*b* in the notch groove 22'*a* and the rotation angle Θ of the cylindrical valve 5*a* are shown. The upper right quadrant will be described below as an example.

In FIG. 6, a horizontal axis represents the rotation angle Θ of the cylindrical valve 5*a* and a vertical axis represents the relationship between the open areas A1 and A2 of the variable throttles 23*a* and 23*b*. Here, an origin point on the horizontal axis represents the initial position of the operating lever 1, a direction of the rotation angle E is positive when the cylindrical valve rotates clockwise in FIG. 3B and is negative when the cylindrical valve 5*a* rotates counterclockwise from the initial position as shown in FIG. 3C.

As shown in FIG. 3A, the notch grooves 22*a* and 22*b* are disposed in a vertical direction and the notch groove 22*a* faces the tank port T in the initial position of the operating lever 1. Moreover, the pump ports Pa and Pb communicate with each other through the oil passage 25. If the operating lever 1 is tilted from a state in FIG. 3A to rotate the cylindrical valve 5*a* clockwise as shown in FIG. 3B, the open area A2 of the variable throttle 23*b* starts to reduce. When the variable throttle 23*a* starts to communicate with the pump port Pa, the open area A1 of the variable throttle 23*a* starts to increase.

An increase rate of the variable throttle 23*a* and a reduction rate of the variable throttle 23*b* are preferably as shown in line graphs in FIG. 6, but are not limited to the line graphs in FIG. 6. The relationships between the open areas of the variable throttles and the rotation angle of the cylindrical valve can be set at proper relationships according to a control mode required as the pilot valve.

Figure 7:
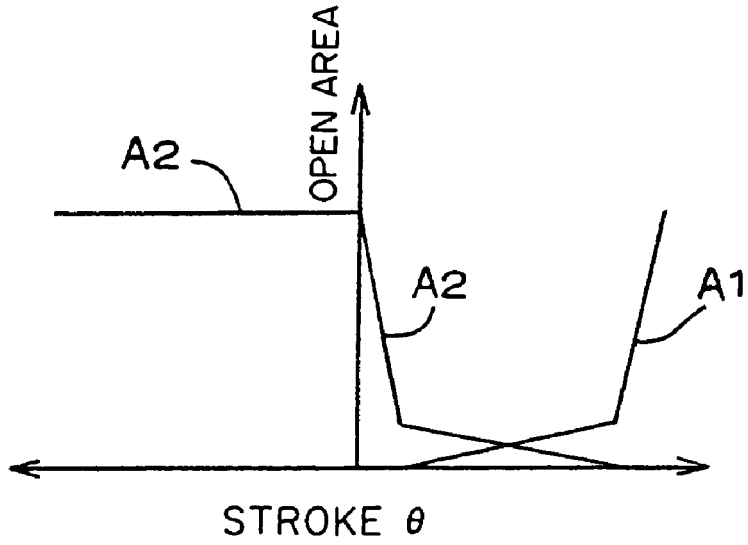
FIG. 7 shows opening characteristics of other variable throttles.

Although FIG. 6 shows the example in which the two output ports P1 and P2 are provided by using the upper right quadrant and the upper left quadrant, opening characteristics as shown in FIG. 7 can be obtained when only one output port is provided. By rotating the cylindrical valve 5*a* clockwise in this manner, the open areas of the variable throttles 23*a* and 23*b* can be controlled according to the rotation angle of the cylindrical valve 5*a*.

Figure 8:
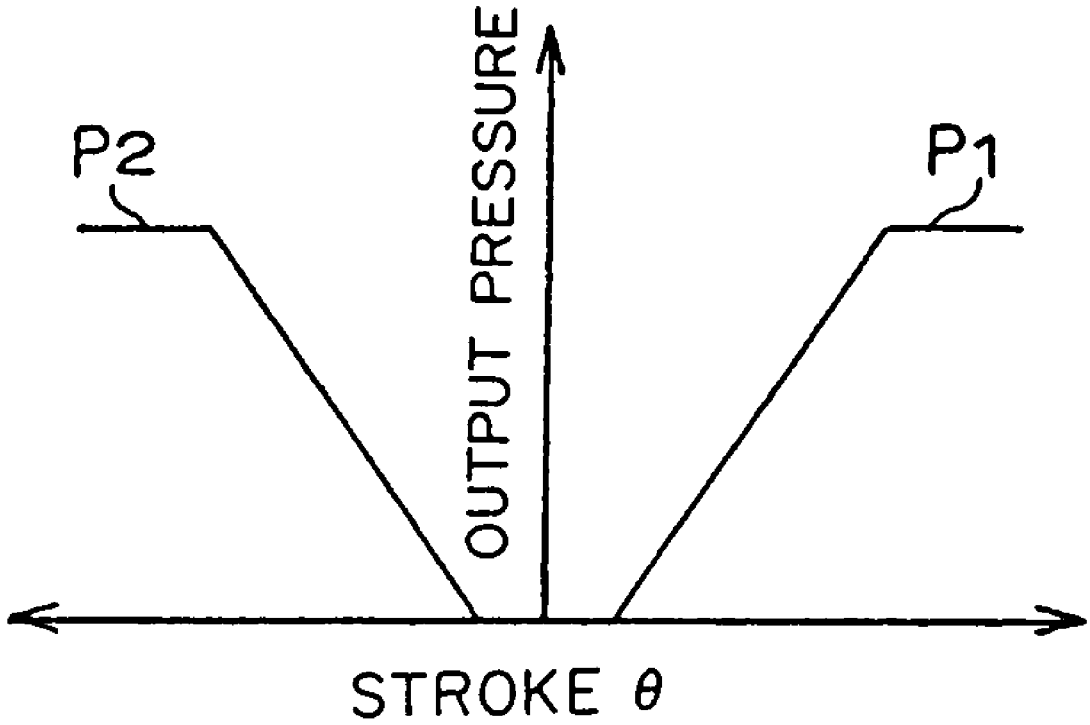
FIG. 8 shows output characteristics.

As shown in FIG. 3B, when the notch groove 22*a* starts to be connected to the pump port Pa, a pilot initial pressure supplied to the pump port Pa is lead into the notch groove 22*a*, a part of the pilot initial pressure passes through the variable throttle 23*b* and is discharged to the tank port T, and the intermediate throttle pressure obtained by the variable throttle 23*a* and the variable throttle 23*b* can be output from the first output port P1. At this time, the output pressure output from the first output port P1 can be controlled to be a straight line shown in an upper right quadrant in FIG. 8.

If the operating lever is tilted in an opposite direction to the above direction to rotate the cylindrical valve 5*a* counterclockwise as shown in FIG. 3C, the notch groove 22*a* turns in such a direction as to connect the tank port T and the pump port P2, and an intermediate throttle pressure between the tank port T and the pump port P2 can be output from the second output port. Relationships between the open areas A'1, A'2 of the variable throttles 23'*a*, 23'*b* and the rotation angle of the cylindrical valve 5*a* at this time can be relationships shown in the upper left quadrant in FIG. 6. An output pressure from the second output port P2 can be a relationship shown in an upper left quadrant in FIG. 8. At this time, the pump port P1 and the pump port P2 always communicate with each other through the oil passage 25.

As a result, the output pressure substantially proportional to the rotation angle Θ of the cylindrical valve 5*a* can be output under control from the first output port P1 or the second output port P2. In other words, because the pilot pressure can be output from the first output port P1 substantially in proportion to the rotation angle of the cylindrical valve 5*a* which is an operated amount of the operating lever 1, the operating lever 1 becomes easy to operate.

Because pressure oil of the pump port P1 can also be lead into the other notch groove 22*b* through the balance hole 24 and the pressure oil of the pump port P1 is also supplied to the pump port P2 through the oil passage 25, hydraulic reaction forces in the diameter direction can balance each other out in the respective notch grooves and the pump ports in the cylindrical valve 5*a*. As a result, the operating force to be applied to the operating lever 1 to rotate the cylindrical valve 5*a* can be reduced and an operating lever of what is called a fingertip type can be obtained.

If the pair of cylindrical valves 5*a* and 5*b* is provided as shown in FIG. 1, the cylindrical valve 5*a* and the cylindrical valve 5*b* can be operated independently of each other. By independently operating the two operating levers 1 and 1, the pilot output pressures can be output selectively from the four output ports P1 to P4.

Figure 9:
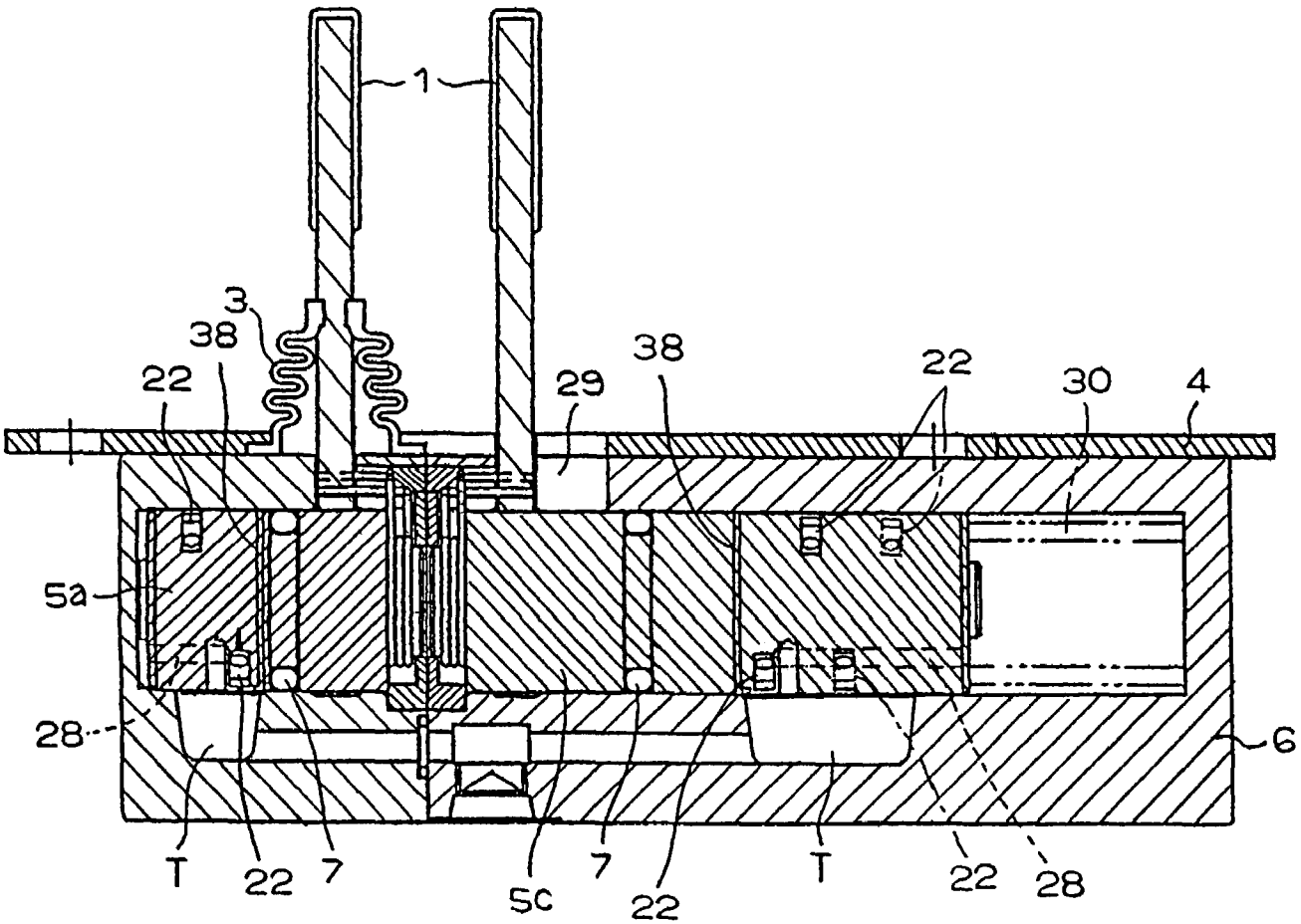
FIG. 9 is a sectional view of a rotary pilot valve in a second embodiment of the invention.

A second embodiment of the invention of the application will be described by using FIGS. 9 and 10. In the second embodiment, a pair of cylindrical valves 5*a* and 5*c* is provided as shown in FIG. 9 like in the first embodiment and the cylindrical valve 5*a* has the same structure as the cylindrical valve 5*a* in the first embodiment. However, the cylindrical valve 5*c* can also be shifted in an axial direction of the rotation axis. Furthermore, by rotating the cylindrical valve 5*c* in a shift position similarly to the cylindrical valves 5*a* and 5*b*, pilot pressures controlled under pressure can be output from the output ports P5, P6 or output ports P7, P8. A position of a notch groove 22 when the cylindrical valve 5*c* is shifted rightward is shown in dotted lines.

Because structures except the structure for shifting the cylindrical valve 5*c* in the direction of the rotation axis are basically similar to those of the cylindrical valves 5*a* and 5*b* in the first embodiment, similar member reference numerals will be used for the similar structures to omit description of them.

A seal 7 provided to the cylindrical valve 5*c* is disposed in such a position as not to project into a sliding guide 29 for the operating lever 1 in the direction of the rotation axis and the tank port T, which are formed in a body 6, even if the cylindrical valve 5*c* is shifted in the direction of the rotation axis. It is also possible that an H-shaped groove guide 27 is formed in a plate 4 and that the operating lever 1 is shifted to a shift position along the H-shaped groove guide 27 as shown in FIG. 10.

Figure 10:
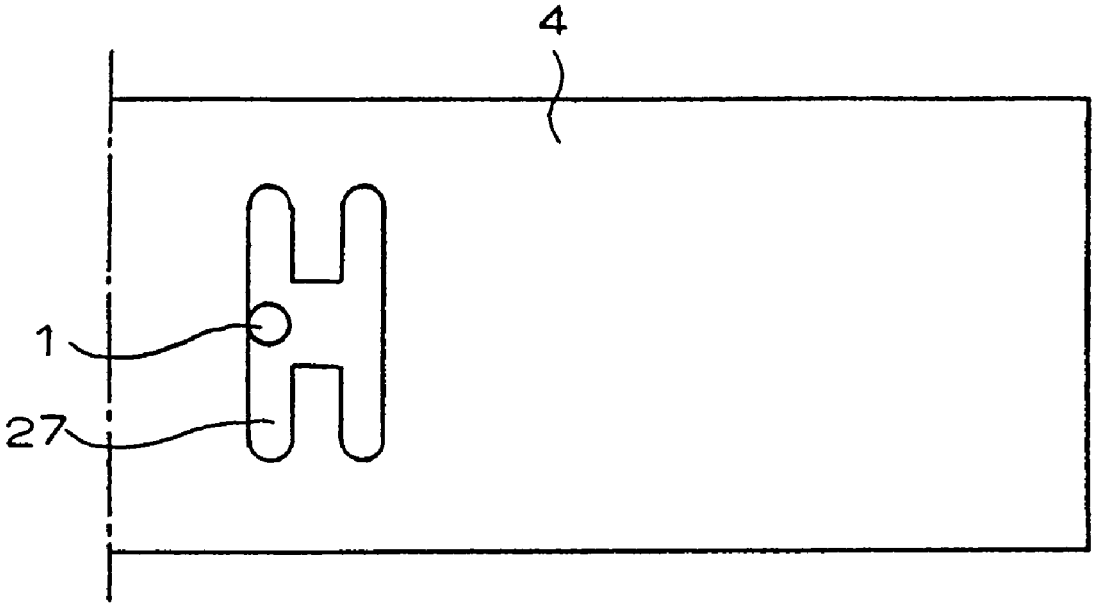
FIG. 10 is a plan view of a plate according to the second embodiment of the invention.

FIG. 10 shows a state in which the operating lever 1 has automatically been returned to an initial position in a left shift position. The operating lever 1 is automatically returned to the initial position in the rotating direction by a torsion spring 8 and is automatically returned to the left shift position by a pressing force of a spring 30 disposed on a right end face of the cylindrical valve 5*c*.

Though it is not shown in the drawings, a detent mechanism is also formed in the cylindrical valve 5*c* and the operating lever 1 can be retained in desired positions in the rotating direction in the left and right shift positions. The detent mechanism is not an absolutely necessary structure.

The cylindrical valve 5*c* is formed with two pairs of notch grooves 22*a* and 22*b* and it is possible to switch between the output port P5 and the output port P6 and to switch between the output port P7 and the output port P8 similarly to FIGS. 3A to 3C by rotating the cylindrical valve 5*c* normally and reversely in the respective shift positions of the cylindrical valve 5*c*. In the cylindrical valve 5*c*, an oil passage 26 connecting an end face and the tank port T is formed.

In the second embodiment, it is possible to output controlled pilot pressures from six ports at the maximum. Furthermore, it is also possible to employ a structure in which the cylindrical valve 5*a* in the second embodiment can be shifted in the direction of the rotation axis similarly to the cylindrical valve 5*c*. In this case, the cylindrical valve 5*a* is shifted in such a direction as to move away from the cylindrical valve 5*c* and it is also possible to switch from eight output ports. By rotating the cylindrical valve 5*a* and the cylindrical valve 5*c* in each shift position by using the operating levers 1, output pressures substantially proportional to the rotation angles of the cylindrical valves 5*a*, 5*c* can be output from the corresponding output ports P1, P2, and P5 to P8 as the pilot pressures.

Figure 11:
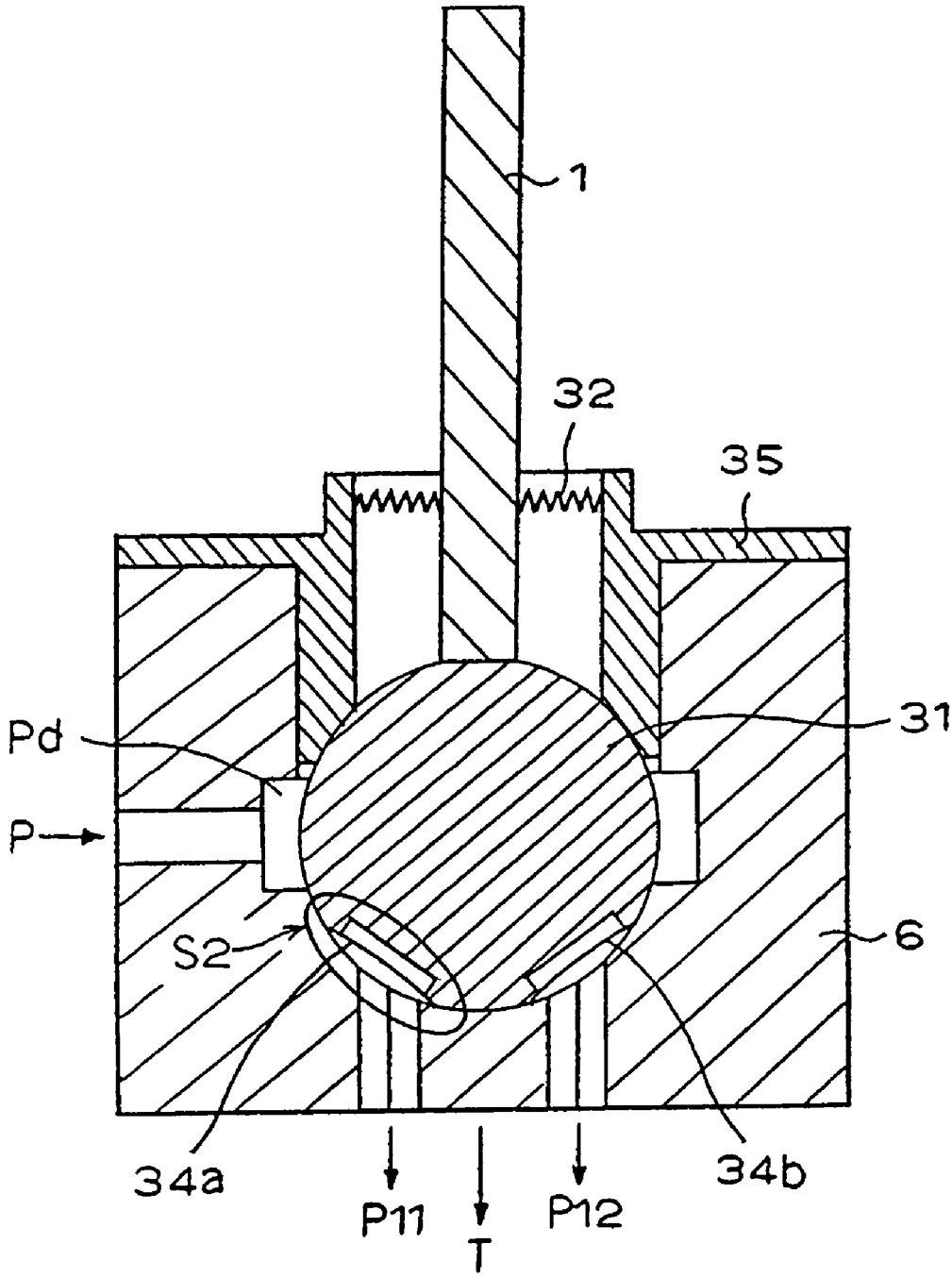
FIG. 11 is a sectional view of a rotary pilot valve in a third embodiment of the invention.
Figure 12:
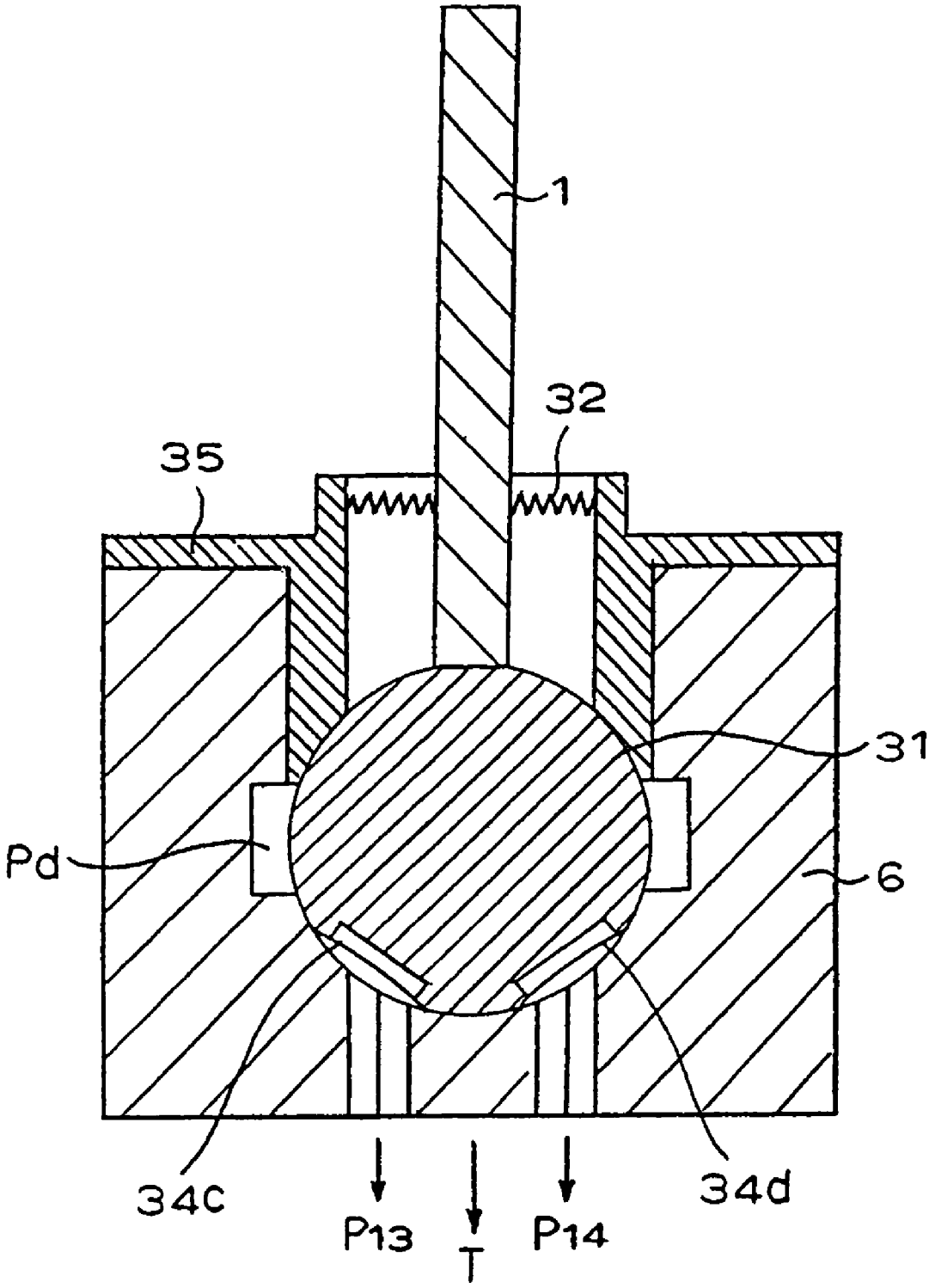
FIG. 12 is a sectional view of the valve in FIG. 11 and turned 90°.
Figure 13:
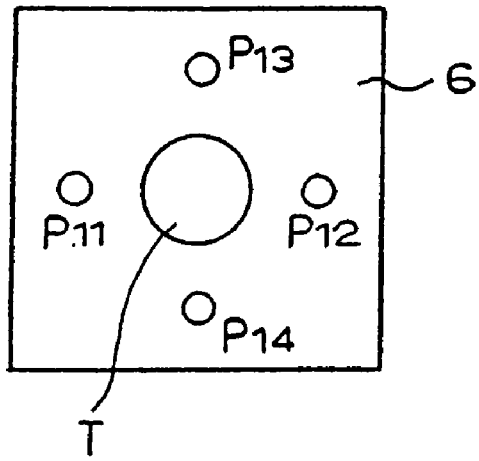
FIG. 13 is a bottom view of the valve in the third embodiment.
Figure 14:
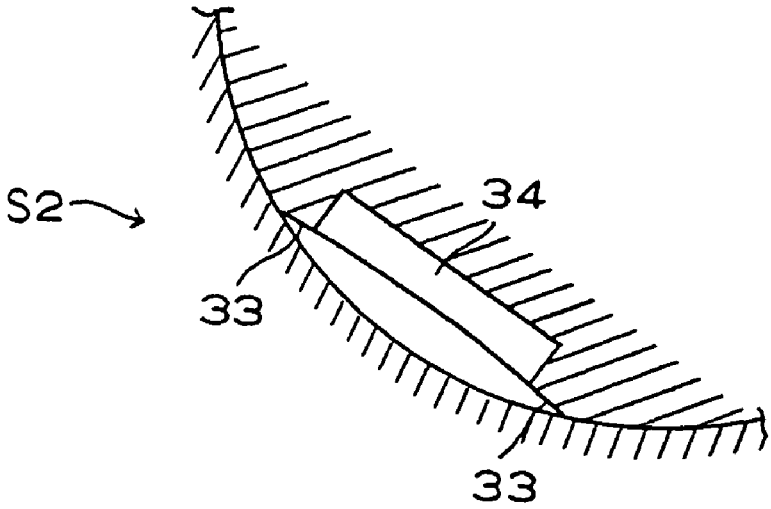
FIG. 14 is an enlarged partial view of a notch groove in the third embodiment.

A third embodiment of the invention of the application will be described by using FIGS. 11 to 15. FIGS. 11 and 12 are vertical sectional views of a rotary pilot valve in the third embodiment and FIG. 13 is a bottom view showing placement of four output ports. FIG. 14 is an enlarged partial view of a notch groove and FIG. 15 is a plan view of the rotary pilot valve in the third embodiment.

In the third embodiment, the rotary valve is a ball valve 31 and intermediate throttle pressures between a tank port T and a pump port Pd can be output from output ports P11 to P14 by rotating the ball valve 31 in a forward-backward direction and a left-right direction with an operating lever 1. Four notch grooves 34*a* to 34*d* are formed in positions corresponding to the respective output ports P11 to P14 and a pump port Pd is formed as an annular groove in a body 6.

At an outer edge portion of each of the notch grooves 34*a* to 34*d*, an arc-shaped variable throttles 33 is formed as shown in FIG. 14. It is also possible to form variable throttles on a side of the tank port T and a side of the annular groove of the pump port Pd, instead of forming the variable throttles 33 by working the outer edge portions of the notch grooves 34*a* to 34*d* into arc shapes. The variable throttles need to be in such shapes that an open area of one variable throttle gradually increases and that an open area of the other variable throttle gradually reduces as the operating lever 1 is tilted.

Figure 15:
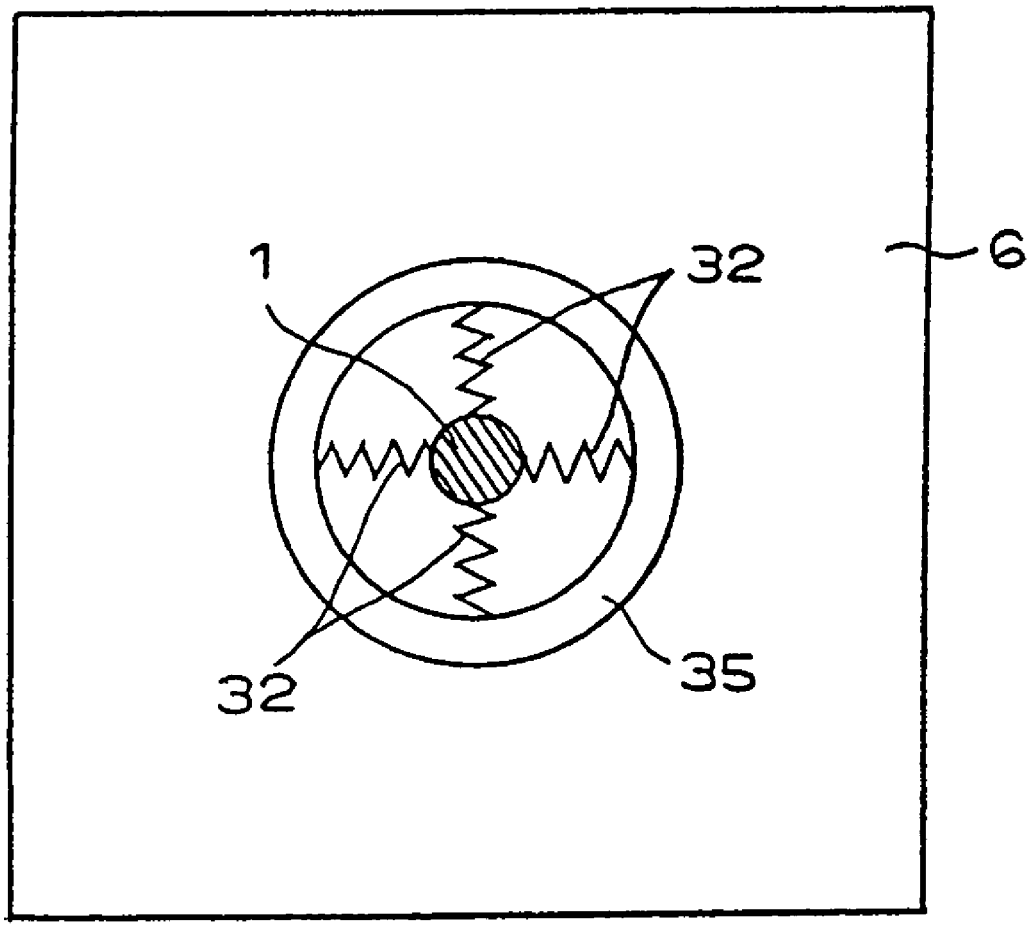
FIG. 15 is a plan view of the valve in the third embodiment.

In order to automatically return the operating lever 1 to a neutral position, i.e., an initial position where tilting starts, springs 32 in four directions are provided to the operating lever 1 as shown in FIG. 15. The ball valve 31 is covered with a bushing 35 from above and is airtightly covered with a boot and the like (not shown). It is also possible to form a cross-shaped groove guide for guiding the operating lever 1 in the left-right and forward-backward directions in the bushing 35.

In FIG. 11, if the operating lever 1 is tilted clockwise, the notch groove 34*a* of the ball valve 31 connects the tank port T and the annular groove of the pump port Pd, and an output pressure according to an amount of tilting of the operating lever 1, i.e., according to a rotation angle of the ball valve 31 can be output from the output port P11 as an intermediate throttle pressure between the pump port Pd and the tank port.

Figure 18:
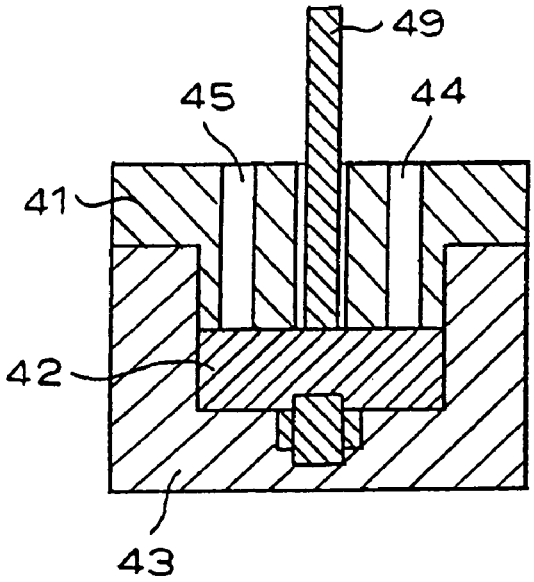
FIG. 18 is a sectional view taken along a line XVIII-XVIII in FIG. 16A.
Figure 19:
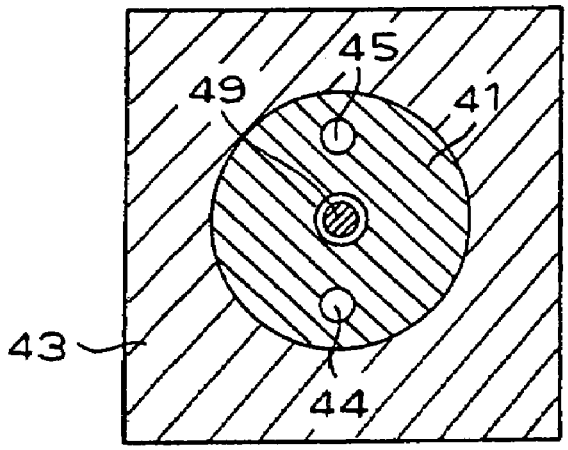
FIG. 19 is a sectional view taken along a line XIX-XIX in FIG. 17.
Figure 20:
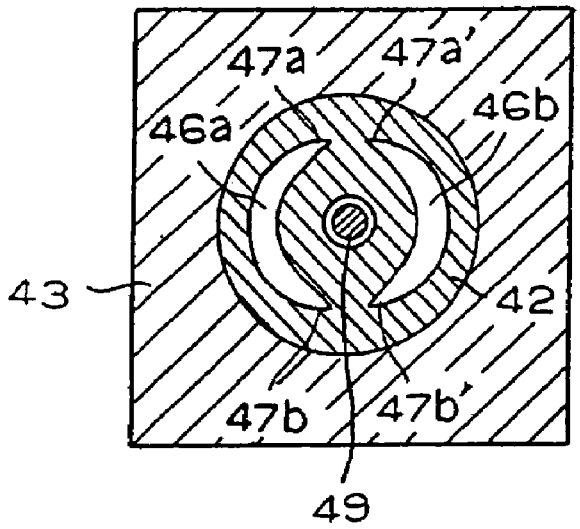
FIG. 20 is a sectional view taken along a line XX-XX in FIG. 17.
Figure 21:
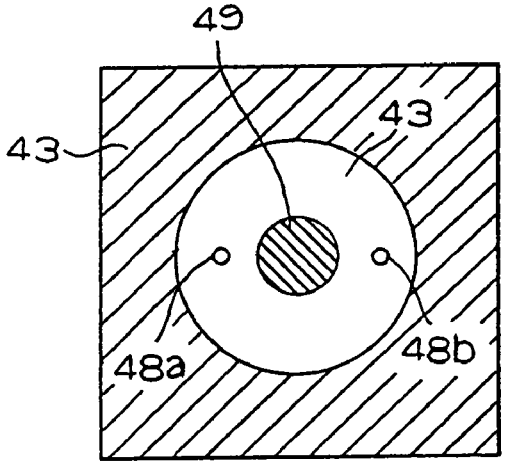
FIG. 21 is a sectional view taken along a line XXI-XXI in FIG. 17.
Figure 22:
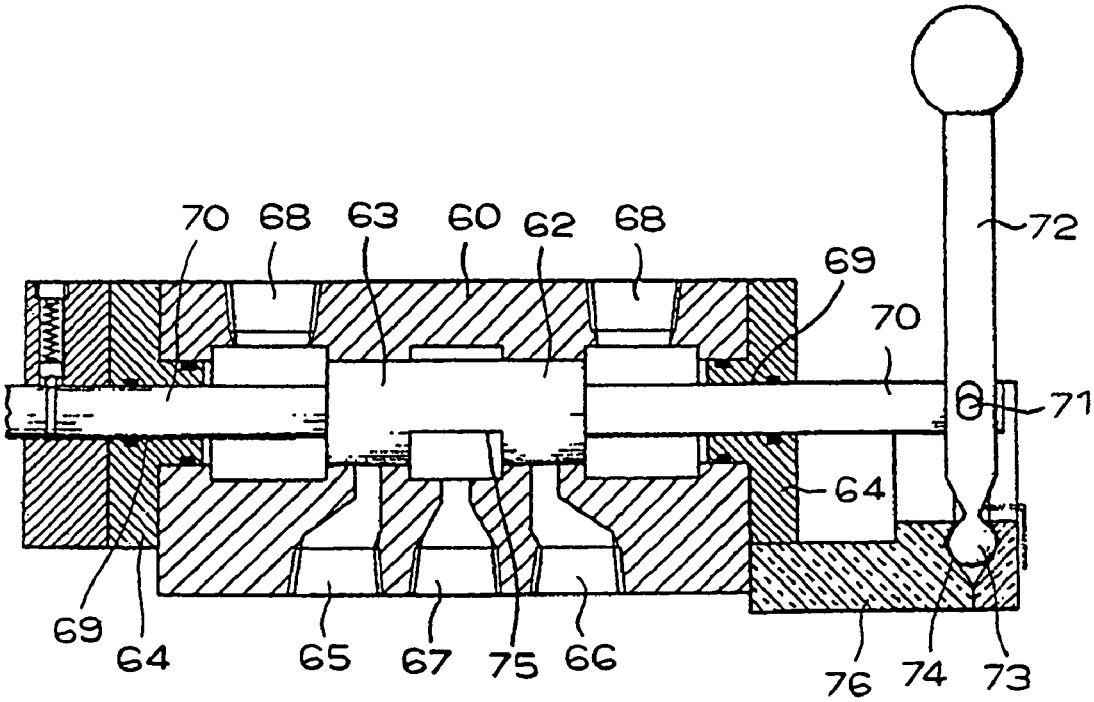
FIG. 22 PRIOR ART
FIG. 22 is a developed sectional view of a pilot valve in prior art.

A fourth embodiment of the invention of the application will be described by using FIGS. 16A to 21. In the fourth embodiment, a rotary valve is a disc valve 42 as shown in FIGS. 17 and 18. By rotating the valve 42 about a rotation axis with an inverted L-shaped operating lever 49, a tank passage 44 and a pump passage 45 formed in a plate 41 as shown in FIG. 19 are connected by a pair of arc-shaped grooves 46*a* and 46*b* formed in the valve 42 and variable throttles 47*a* and 47*b* formed at respective end edge portions of the arc-shaped grooves 46*a* and 46*b* as shown in FIG. 20, and an intermediate throttle pressure between the tank passage 44 and the pump passage 45 can be output to a first output passage 48*a* or a second output passage 48*b* formed in a body 43 as shown in FIG. 21. At this time, the variable throttles 47*a* and 47*b* are in such shapes that one of their open areas gradually increases and that the other gradually reduces according to a rotation angle of the valve 42.

Figure 16A:
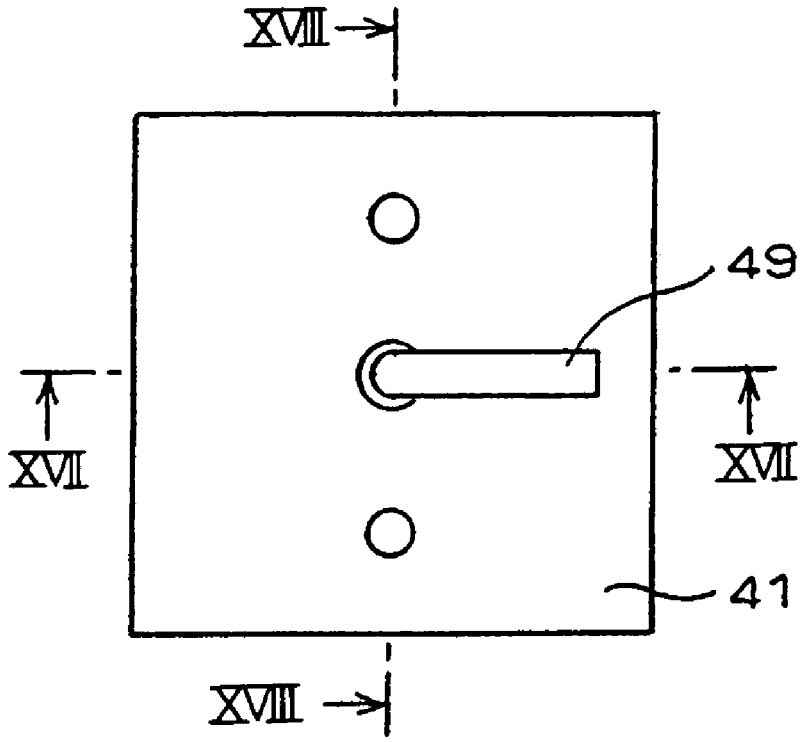
FIG. 16A is a plan view of a valve in a fourth embodiment
Figure 16B:
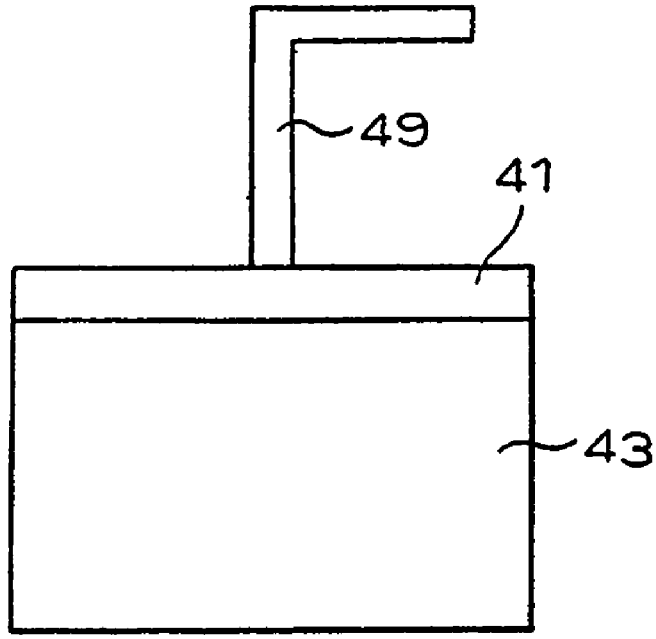
FIG. 16B is a side view of a valve in the fourth embodiment.
Figure 17:
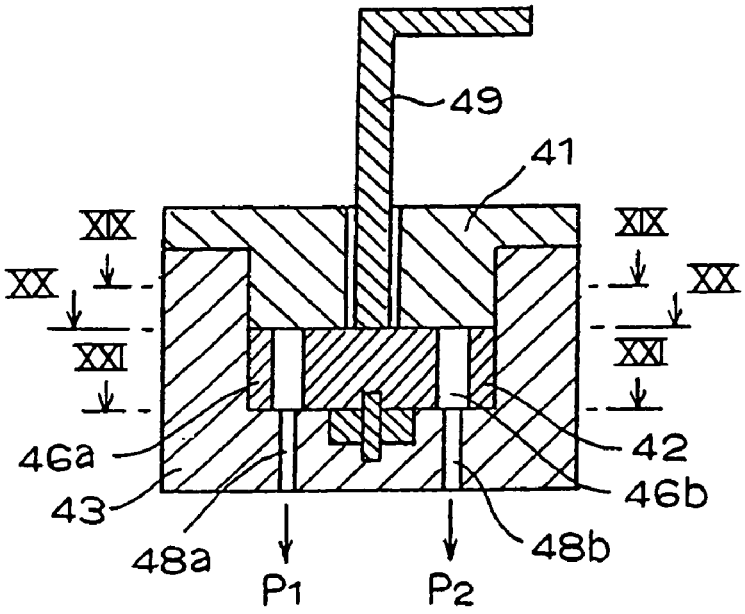
FIG. 17 is a sectional view taken along a line XVII-XVII in FIG. 16A.

The operating lever 49 may be formed in the inverted L shape as shown in FIGS. 16B and 17 or may be formed as an operating knob or the like in a shape of a cylindrical column which has a predetermined diameter and vertical grooves on a circumference thereof. Operating members in various shapes other than the operating lever and the operating knob may be used as long as the valve 42 can be rotated about the rotation axis with the member.

According to the invention of the application, the intermediate throttle pressure between the tank port and the pump port can be output to the output port by rotating the rotary valve and the output pressure from the output port is substantially proportional to the rotation angle of the rotary valve. Therefore, it is possible to control the output pressure from the output port in proportion to the operated amount of the operating lever.

The notch grooves are formed in the balance positions in the diameter direction of the rotary valve, the notch grooves are connected to each other by the balance hole, and the projected areas of the pair of notch grooves are made equal to each other. As a result, the same oil pressure acts on the notch grooves, the resistance acting in the opposite direction to the rotating direction of the rotary valve is not generated, and the rotary valve can be smoothly rotated with a small force, e.g., a force of a finger.

Moreover, by using the detent mechanism, the operating lever which has been operated with one finger can be retained in the predetermined position. Furthermore, by using the torsion spring or the like, the operating lever can automatically be returned to the initial position.

What is claimed is:

1. A rotary pilot valve comprising:

a pair of notch grooves formed in a peripheral face of a rotary valve;

a tank port, a pump port, and an output port formed in an inner peripheral face of a body;

a pair of variable throttles respectively formed on a side of the pump port and a side of the tank port of the pair of notch grooves;

an operating lever for operating the rotary valve by rotation, wherein throttle open areas of the pair of variable throttles are formed in such shapes that the throttle open area of one of the variable throttles gradually increases while the throttle open area of the other gradually reduces according to a rotation angle of the rotary valve by the operating lever, wherein an intermediate throttle pressure between the pump port and the tank port and substantially proportional to the rotation angle of the rotary valve is output from the notch groove to the output port wherein the pair of notch grooves is formed in pressure balance positions in a diameter direction of the rotary valve, wherein the pair of notch grooves communicate with each other through a balance hole, wherein the variable throttles are formed at the notch groove for communicating between the pump port and the tank port, wherein the intermediate throttle pressure is output from the notch groove to the output port, wherein the two sets each including the tank port, the output port and the pump port respectively disposed in positions along normal and reverse rotating directions of the rotary valve around the tank port are formed, wherein the intermediate throttle pressure between the pump port and the tank port in one of the sets is output to the output port of a same set by normal and reverse rotations of the rotary valve by the operating lever, wherein two pairs of notch grooves are formed in positions separate from each other along a direction of a rotation axis of the rotary valve, and wherein the tank ports, the output ports, and the pump ports of the respective sets are disposed in positions corresponding to the respective pairs of notch grooves separate from each other.

2. A rotary pilot valve according to claim 1, further comprising an automatic return mechanism with which the operating lever is automatically returned to an initial position where tilting starts.

3. A rotary pilot valve according to claim 1, further comprising a detent mechanism with which the operating lever can be retained in a tilted position.

4. A rotary pilot valve according to claim 1, wherein the body includes a structure for airtightly housing the rotary valve.

5. A rotary pilot valve according to claim 1, wherein the rotary valve is a cylindrical valve.

6. A rotary pilot valve according to claim 5, wherein a plurality of cylindrical valves are arranged in series along an axial direction of the valves.

7. A rotary pilot valve according to claim 1, wherein the rotary valve is a ball valve.

8. A rotary pilot valve according to claim 1, wherein the rotary valve is a stone mill like disc valve.

9. A rotary pilot valve comprising:

a pair of notch grooves formed in a peripheral face of a rotary valve;

two sets of ports, each including a tank port, a pump port, and an output port formed in an inner peripheral face of a body, each set corresponding to a notch groove;

a pair of variable throttles respectively formed on a side of the pump port and a side of the tank of each notch groove, and an operating lever for operating the rotary valve by rotation, wherein each notch groove is formed in such shapes that one throttle open area of the pair of the variable throttles gradually increases while throttle open area of the other gradually reduces according to a rotation angle of the rotary valve by the operating lever, wherein each set of ports is disposed in positions along normal and reverse rotating directions of the rotary valve around the tank port are formed, wherein the intermediate throttle pressure between the pump port and the tank port in one of the sets is output to the output port of a same set by normal and reverse rotations of the rotary valve by the operating lever, wherein two pairs of notch grooves are formed in positions separate from each other along a direction of a rotation axis of the rotary valve, and the tank ports, the output ports, and the pump ports of the respective sets are disposed in positions corresponding to the respective pairs of notch grooves separate from each other, and wherein an intermediate throttle pressure between the pump port and the tank port and substantially proportional to the rotation angle of the rotary valve is output from the notch groove to the output port.

* * * * *

UNITED STATES PATENT AND TRADEMARK OFFICE

CERTIFICATE OF CORRECTION

PATENT NO. : 7,578,313 B2
APPLICATION NO. : 10/800794
DATED : August 25, 2009
INVENTOR(S) : Kozuka et al.

It is certified that error appears in the above-identified patent and that said Letters Patent is hereby corrected as shown below:

On the title page,

[*] Notice: Subject to any disclaimer, the term of this patent is extended or adjusted under 35 U.S.C. 154(b) by 445 days.

Delete the phrase "by 445 days" and insert -- by 883 days --

Signed and Sealed this

Seventeenth Day of August, 2010

David J. Kappos

David J. Kappos
*Director of the United States Patent and Trademark Office*